US007803242B2

(12) United States Patent
Hagman et al.

(10) Patent No.: US 7,803,242 B2
(45) Date of Patent: Sep. 28, 2010

(54) APPARATUS AND METHOD FOR SPLICING AN ELONGATE MULTI-LAYERED WORKPIECE

(75) Inventors: Thomas J. Hagman, Seattle, WA (US); Ralph D. Cope, Elkton, MD (US); Ross Hutter, Lincoln University, PA (US); Steven A. Cope, Newark, DE (US); Kim Ferrara, Middletown, DE (US); Nanette M. Gopez, Newark, DE (US); Michael J. Case, Bear, DE (US)

(73) Assignee: Boeing Company, Chicago, IL (US)

( * ) Notice: Subject to any disclaimer, the term of this patent is extended or adjusted under 35 U.S.C. 154(b) by 594 days.

(21) Appl. No.: 11/763,013

(22) Filed: Jun. 14, 2007

(65) Prior Publication Data

US 2008/0308213 A1 Dec. 18, 2008

(51) Int. Cl.
*B65H 69/06* (2006.01)
*B65H 69/02* (2006.01)
*B26D 7/06* (2006.01)

(52) U.S. Cl. ..... 156/159; 156/157; 156/502; 156/504; 242/556

(58) Field of Classification Search ..... 156/159
See application file for complete search history.

(56) References Cited

U.S. PATENT DOCUMENTS

| | | | | |
|---|---|---|---|---|
| 4,951,893 | A | 8/1990 | Yuito | |
| 6,189,587 | B1 | 2/2001 | Cairns | |
| 2002/0100539 | A1 | 8/2002 | Harding | |
| 2003/0089760 | A1 * | 5/2003 | Nobbe | 228/171 |
| 2007/0029037 | A1 * | 2/2007 | Deininger | 156/293 |
| 2007/0044896 | A1 | 3/2007 | Tingley | |

FOREIGN PATENT DOCUMENTS

| | | | |
|---|---|---|---|
| DE | 19502350 | A1 * | 8/1996 |
| EP | 1201585 | A1 | 5/2002 |
| EP | 1304214 | A2 | 9/2002 |

OTHER PUBLICATIONS

Patent Cooperation Treaty international Search Report; International Application No. PCT/US2008/067017, filed Jun. 13, 2008; Applicant The Boeing Company.

* cited by examiner

*Primary Examiner*—Joseph S Del Sole
*Assistant Examiner*—Vicki Wu
(74) *Attorney, Agent, or Firm*—Law Office of Donald D. Mondul

(57) ABSTRACT

An apparatus for splicing an elongate multi-layered workpiece includes: (a) drives and guides cooperating to drive the workpiece along a working path; (b) a cutter for severing the workpiece; (c) a layer manipulator for separating layers; (d) an applicator for applying adhesive; and (e) a deflector unit for deflecting the workpiece from the working path. The cutter effects the severing to present first and second workpiece segments. The layer manipulator effects inter-layer separation in one segment to present an interlayer zone in the one segment. A drive inserts the other segment in the interlayer zone. The layer manipulator urges the layers together to capture the other segment within the interlayer zone to establish a multi-layer structure. A drive and at least one of the workpiece deflector unit and the applicator situate the multi-layer structure adjacent to the applicator for finishing the splicing by applying adhesive to the multi-layer structure.

6 Claims, 12 Drawing Sheets

10

10

10

10

10

APPARATUS AND METHOD FOR SPLICING AN ELONGATE MULTI-LAYERED WORKPIECE

BACKGROUND

Elongate workpieces may include, by way of example and not by way of limitation, a multilayered tape stored on a reel Such tape workpieces may be used, by way of further example and not by way of limitation, in a manufacturing process that may include a material having a backing layer covering one face of the material. The backing layer may protect an adhesive or another feature of the covered face of the material until the material is used. It may be advantageous to be able to splice lengths of an elongate workpiece such as a tape workpiece in order to reduce waste, to reuse reels for storing the workpiece material, to consolidate partial reels to a full reel so as to conserve space or material or for another reason. It may also be advantageous for a spliced workpiece to be substantially as strong as an unspliced workpiece. While a splice may initially be weaker than the unspliced material, the initial splice may only need to be strong enough to maintain integrity though a process in which a workpiece is employed, such as a laminating process using a tape-like workpiece to create a surface area of a part. Once a part in which a workpiece is included may be cured, any discontinuity occasioned by a splice may have little influence on the strength of the finished and cured part. It may further be advantageous for a spliced workpiece to be substantially free of significant gaps or other discontinuities.

There is a need for an apparatus and method for splicing an elongate multi-layered workpiece that can present a spliced elongate workpiece that is substantially as strong as an unspliced workpiece.

There is a need for an apparatus and method for splicing an elongate multi-layered workpiece that can present a spliced elongate workpiece having few significant gaps or other discontinuities.

SUMMARY

An apparatus for splicing an elongate multi-layered workpiece includes: (a) drives and guides cooperating to drive the workpiece along a working path; (b) a cutter for severing the workpiece; (c) a layer manipulator for separating layers; (d) an applicator for applying adhesive; and (e) a deflector unit for deflecting the workpiece from the working path. The cutter effects the severing to present first and second workpiece segments. The layer manipulator effects inter-layer separation in one segment to present an interlayer zone in the one segment. A drive inserts the other segment in the interlayer zone. The layer manipulator urges the layers together to capture the other segment within the interlayer zone to establish a multi-layer structure. A drive and at least one of the workpiece deflector unit and the applicator situate the multi-layer structure adjacent to the applicator for finishing the splicing by applying adhesive to the multi-layer structure. The apparatus may include sensors for detecting defects and splices. The apparatus may also include a measurement unit for determining the amount of material remaining on a returned supply reel. When recovering unused material, a take up reel may be filled to a level that may allow the material on the returned supply reel to finish filling the take up reel. This may result in "older" material being situated on the outside of the take up reel so the older material will be used first. When recovering unused material, any previously made splices in the returned material may be removed. If the splice is not removed and replaced, the orientation of the layers may be incompatible with the laminating equipment with which the workpiece may be employed, such as for laminating a surface for an aircraft wing.

A method for splicing an elongate workpiece having a plurality of materials substantially abuttingly oriented in a plurality of layers includes: (a) in no particular order: (1) providing a plurality of drive units arranged for driving the workpiece along a working path; and (2) providing a plurality of guide structures arranged for cooperating with the plurality of drive units for guiding the workpiece along the working path; (b) operating a cutting unit for effecting severing of the workpiece to present a first segment of the workpiece and a second segment of the workpiece; (c) operating a layer manipulating unit to effect an inter-layer separation in a portion of one segment of the first segment and the second segment to present an interlayer zone in the one segment; (d) operating at least one drive means of the plurality of drive means to insert the other segment in the interlayer zone; (e) operating the layer manipulating unit to urge the selected layers together to generally capture the other segment within the interlayer zone to establish a multi-layer structure; and (f) operating the plurality of drive units and the adhering unit to situate the multi-layer structure adjacent to the adhering unit for finishing the splicing by applying the adhesive to the multi-layer structure.

It is, therefore, a feature of embodiments of the invention to present an apparatus and method for splicing an elongate multi-layered workpiece that can present a spliced elongate workpiece that is substantially as strong as an unspliced workpiece.

It is another feature of embodiments of the invention to present an apparatus and method for splicing an elongate multi-layered workpiece that can present a spliced elongate workpiece having few significant gaps or other discontinuities.

Further features of embodiments of the invention will be apparent from the following specification and claims when considered in connection with the accompanying drawings, in which like elements are labeled using like reference numerals in the various figures, illustrating embodiments of the invention.

DETAILED DESCRIPTION

Figure 1:
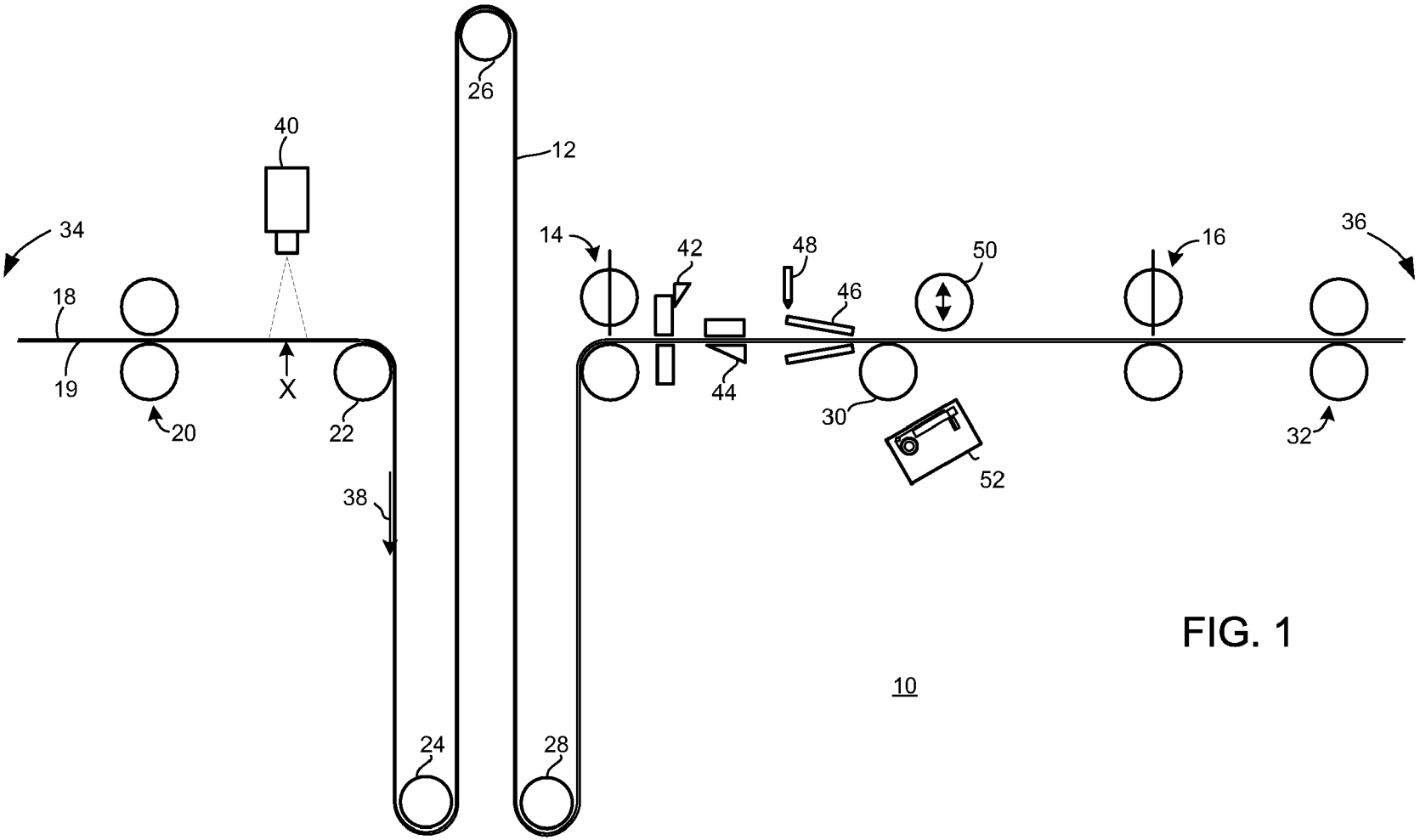
FIG. 1 is a schematic illustration of an embodiment of the apparatus.

FIG. 1 is a schematic illustration of an embodiment of the apparatus. In FIG. 1, a splicing apparatus 10 may process an elongate workpiece 12 flowing generally from left to right in FIG. 1. Workpiece 12 may be a multi-layered elongate material such as a tape material layer 18 having a backing or other protective material layer 19 on one side of tape material 18. Apparatus 10 may include drive units 14, 16 and guide units or structures 20, 22, 24, 26 28, 30, 32 may cooperate to drive and guide workpiece 12 along a working path 38. Working path 38 may generally trace the pattern traversed by workpiece 12 in FIG. 1, and may lie substantially in the plane in which FIG. 1 may be displayed. By way of example and not by way of limitation, drive units 14, 16 may be embodied in paired nip roller assemblies.

Apparatus 10 may include a defect detector unit 40 situated to carry out inspection of workpiece 12 at a locus "X" as workpiece 12 travels past defect detector unit 40 along working path 38. Guide units 24, 26, 28 may create a material buffer by increasing the length of workpiece 12 between defect detector unit 40 and cutting unit 42. If a second defect is found in workpiece 12 before the first defect reaches cutting unit 42, all workpiece 12 between the two defects may be discarded to ensure that two splices are not located closer than the length of the material buffer established by guide units 24, 26, 28. Apparatus 10 may further include a cutting unit 42 situated generally next to or astride working path 38 in an orientation permitting severing of workpiece 12 as workpiece 12 traverses working path 38. Apparatus 10 may also include a workpiece redirecting unit 44, a layer manipulating unit 46, a heater element 48, a workpiece deflecting unit 50 and an adhering unit 52.

A supply reel or other supply mechanism (not shown in FIG. 1) may provide workpiece 12 from the upstream end 34 of working path 38 at the left side of FIG. 1. A take-up reel or other collecting mechanism (not shown in FIG. 1) may collect workpiece 12 at the downstream end 36 of working path 38 at the right side of FIG. 1.

Figure 2:
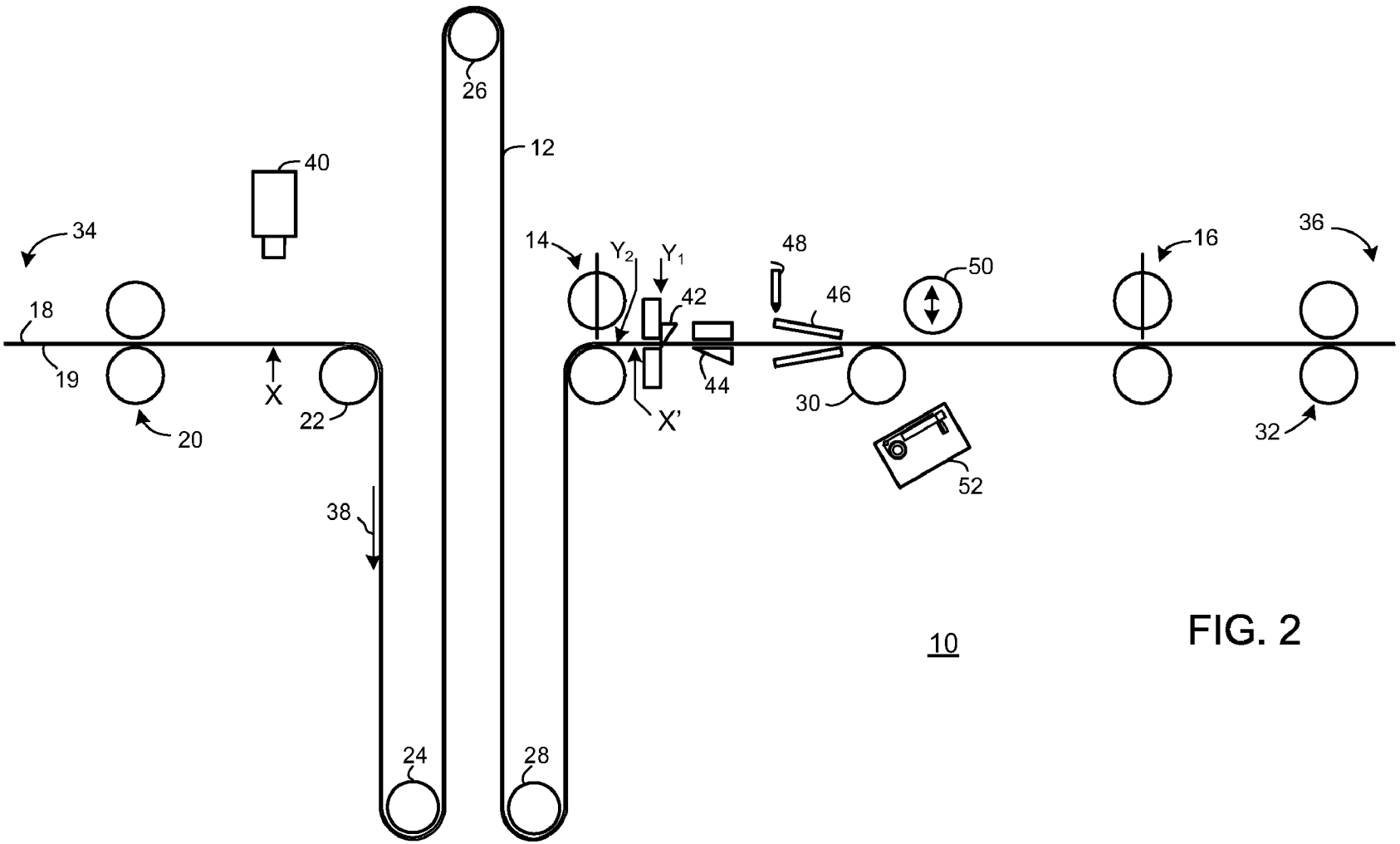
FIG. 2 is a schematic illustration of an embodiment of the apparatus effecting a severing of the workpiece.

FIG. 2 is a schematic illustration of an embodiment of the apparatus effecting a severing of the workpiece. In FIG. 2, workpiece 12 may have progressed along working path 38 to an orientation placing the observed defect first appearing at locus X at a new locus X' upstream of cutting unit 42. Cutting unit 42 may reoriented to a cutting position traversing working path 38 so as to begin removing the detected defect at locus X' by cutting workpiece 12 at a locus $Y_1$. Loci $Y_1$, $Y_2$ may bound an interval that spans the defect at locus X'.

Figure 3:
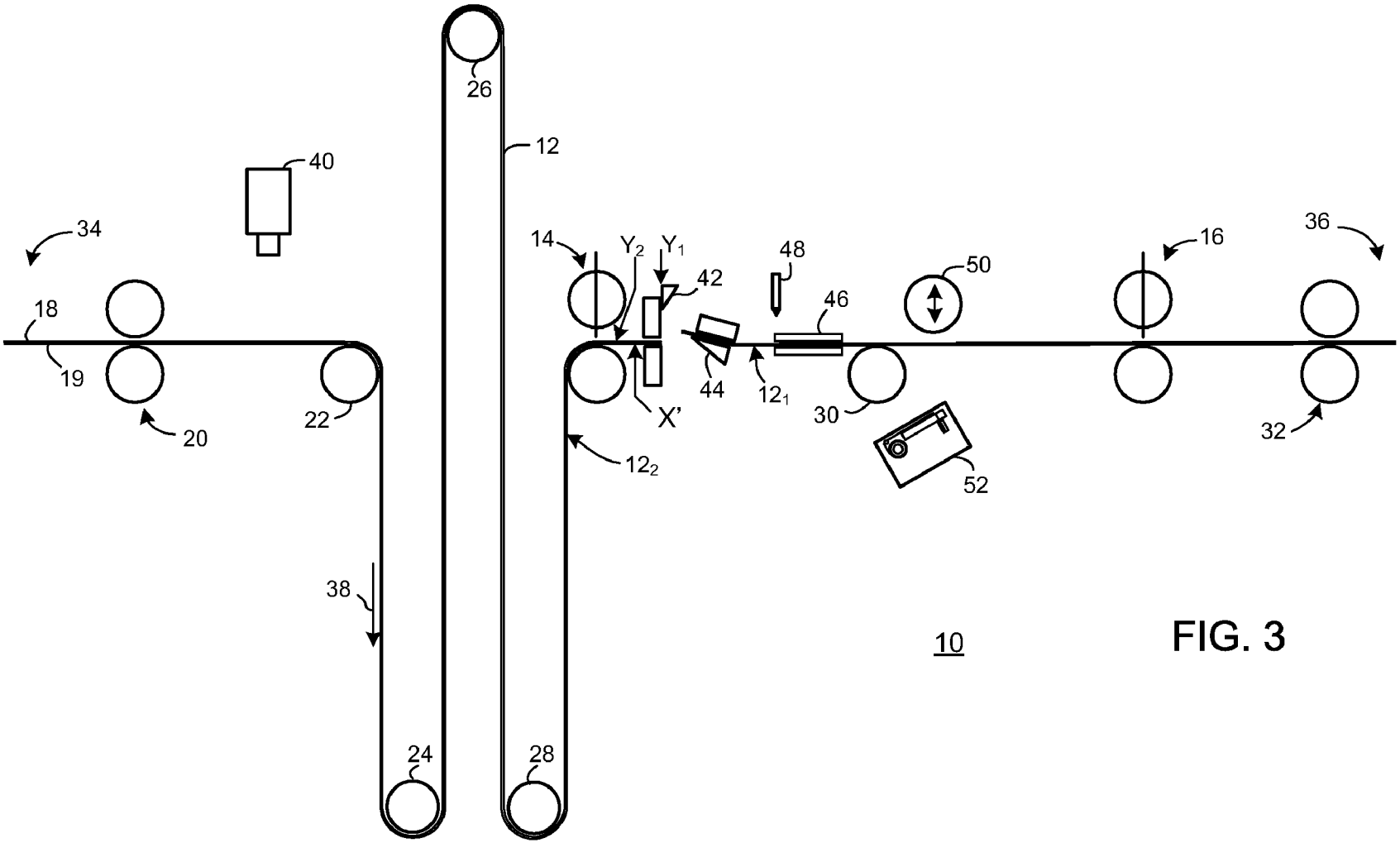
FIG. 3 is a schematic illustration of an embodiment of the apparatus effecting a clearing of the workpiece path to carry out a splicing operation.

FIG. 3 is a schematic illustration of an embodiment of the apparatus effecting a clearing of the workpiece path to carry out a splicing operation. In FIG. 3, cutting unit 42 may have completed severing of workpiece 12 at locus $Y_1$. Cutting unit 42 may be retracted to a position displaced from and clearing working path 38, as shown in FIG. 3, and workpiece redirecting unit 44 may be tilted to clear a leading segment $\mathbf{12}_1$ of workpiece 12 from working path 38, also as shown in FIG. 3. A trailing segment $\mathbf{12}_2$ of workpiece 12 may remain generally in working path 38.

Figure 4:
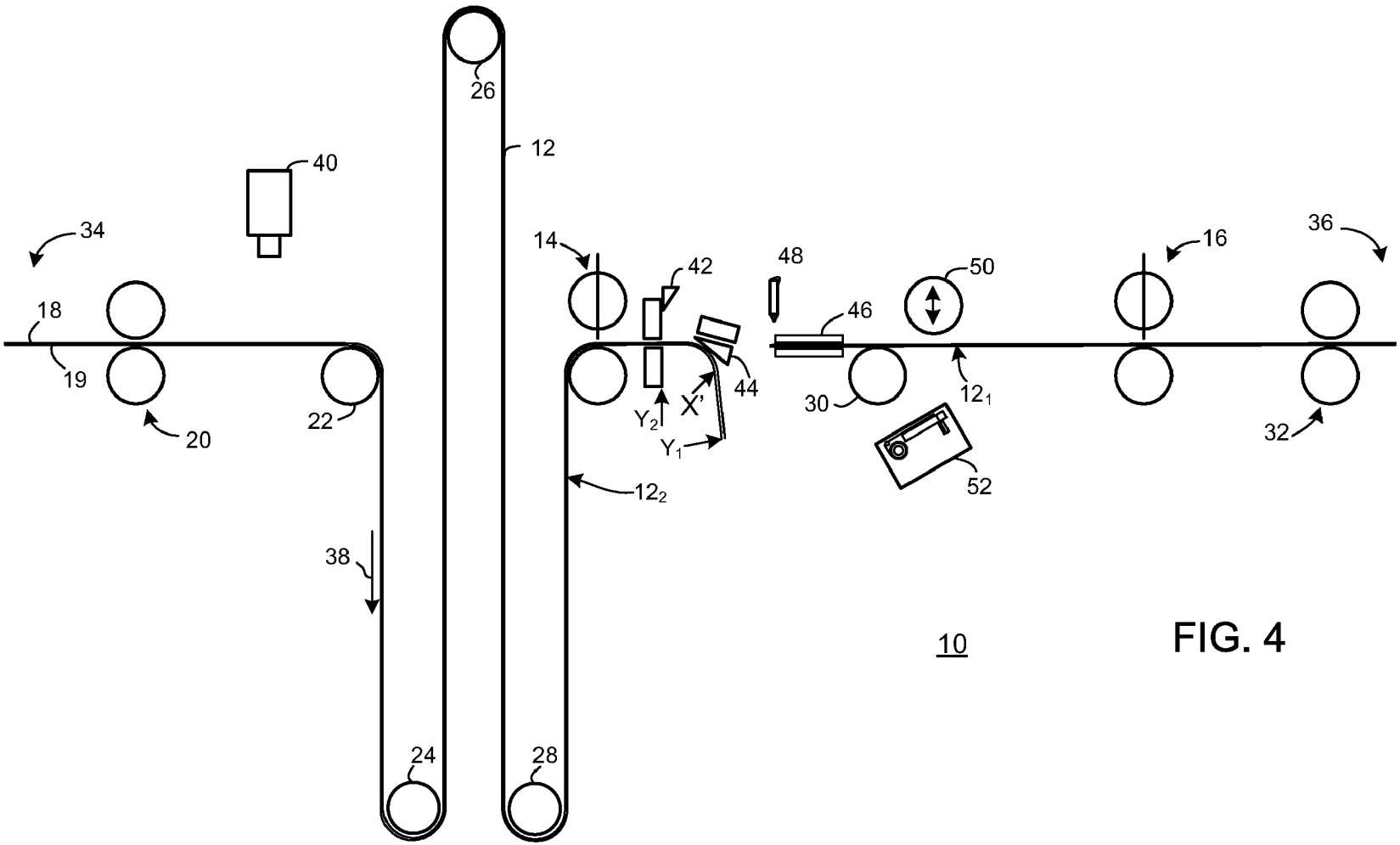
FIG. 4 is a schematic illustration of an embodiment of the apparatus effecting an advancing of the workpiece path to carry out a splicing operation.

FIG. 4 is a schematic illustration of an embodiment of the apparatus effecting an advancing of the workpiece path to carry out a splicing operation. In FIG. 4, drive unit 16 may advance leading segment $\mathbf{12}_1$ of workpiece 12 to substantially fully orient leading segment $\mathbf{12}_1$ within layer manipulating unit 46, and layer manipulating unit 46 may be closed upon leading segment $\mathbf{12}_1$ in preparation for separating layers 18, 19 of leading segment $\mathbf{12}_1$. Drive unit 14 may advance trailing segment $\mathbf{12}_2$ of workpiece 12 to encounter workpiece redirecting unit 44 so as to cause trailing segment $\mathbf{12}_2$ to deviate from working path 38. Drive unit 14 may advance trailing segment $\mathbf{12}_2$ to substantially align locus $Y_2$ with cutting unit 42

Figure 5:
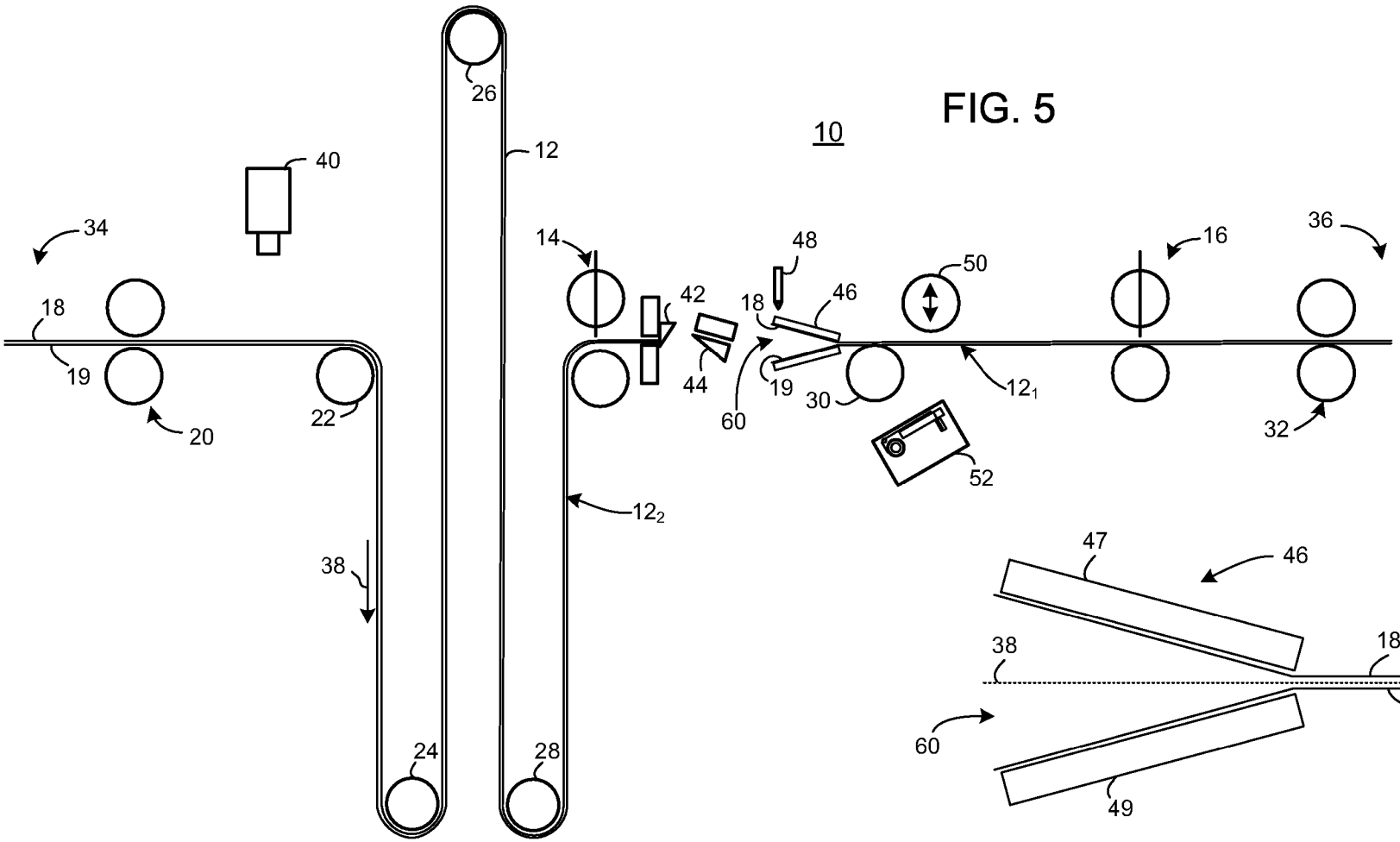
FIG. 5 is a schematic illustration of an embodiment of the apparatus effecting an interlayer separation of the workpiece path to carry out a splicing operation.

FIG. 5 is a schematic illustration of an embodiment of the apparatus effecting an interlayer separation of the workpiece path to carry out a splicing operation. FIG. 5 may also show severing of the upstream segment of a workpiece to remove a scrap portion. In FIG. 5, cutting unit 42 may have effected severing of workpiece 12 at locus $Y_2$ (see FIG. 4) and the severed segment $Y_1$-$Y_2$ (see FIG. 4) may have been discarded. Layer manipulation unit 46 may have separated layers 18, 19 of leading segment $\mathbf{12}_1$ to present an interlayer zone 60 between separated layers 18, 19.

Figure 6:
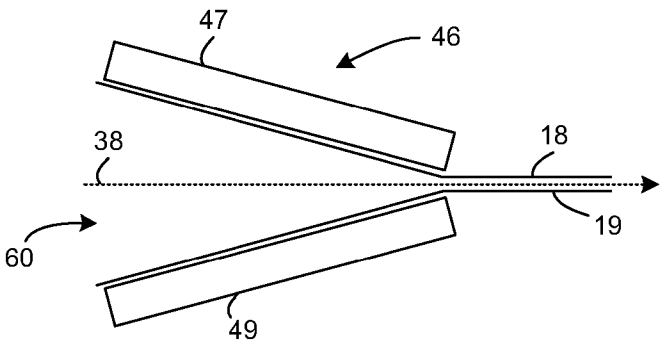
FIG. 6 is an enlarged schematic illustration showing details of an interlayer separation.

FIG. 6 is an enlarged schematic illustration showing details of an interlayer separation. In FIG. 6, layer manipulation unit 46 may include a first jaw member 47 in hinged relation with a second jaw member 49. Jaw members 47, 49 may be generally symmetrically arranged with respect to working path 38. Jaw members 47, 49 may be provided with vacuum ports (not shown in FIG. 6; well known to those skilled in the art of elongate workpiece handling equipment) to substantially fix layer 18 against jaw member 47 and substantially fix layer 19 against jaw member 49. When ready to separate layers 18, 19 jaw members 47, 49 may hingedly swing apart to separate and thereby effect separation of layers 18, 19. Separation of layers 18, 19 may present interlayer zone 60 between layers 18, 19.

Figure 7:
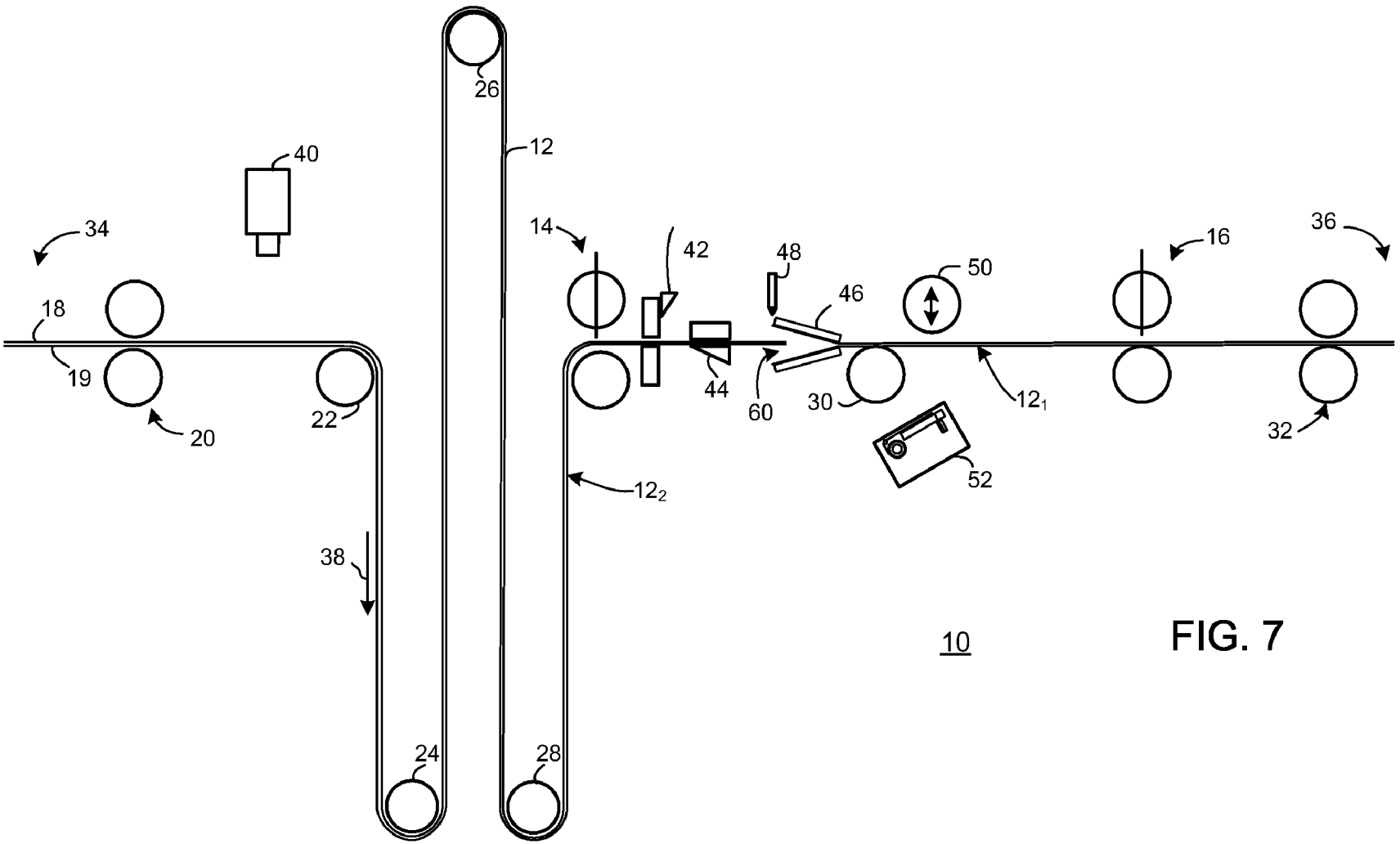
FIG. 7 is a schematic illustration of an embodiment of the apparatus effecting an advancing of a portion of a workpiece toward an interlayer zone to carry out a splicing operation.

FIG. 7 is a schematic illustration of an embodiment of the apparatus effecting an advancing of a portion of a workpiece toward an interlayer zone to carry out a splicing operation. In FIG. 7, cutting unit 42 may have cleared working path 38, workpiece redirecting unit 44 may have been reoriented to permit passage of trailing segment $\mathbf{12}_2$ of workpiece 12 along working path 38 past or through workpiece redirecting unit 44 and drive unit 14 may have advanced trailing segment $\mathbf{12}_2$ forward (i.e., to the right in FIG. 7) to extend a portion of trailing segment $\mathbf{12}_2$ into interlayer zone 60. Heater element 48 may begin to heat trailing segment $\mathbf{12}_2$. Some tape material layers 18 may contain uncured resin material, such as by way of example and not by way of limitation when tape material layer 18 may be configured as a graphite tape material. Such uncured resin material may be affected when subjected to heat to increase stickiness of tape material layer 18. Heating element 48 may be advantageously employed in aiding interlayer adhesion for splicing of workpiece 12 when such heat-susceptible tape material 18 is included in workpiece 12.

Figures 8, 9:
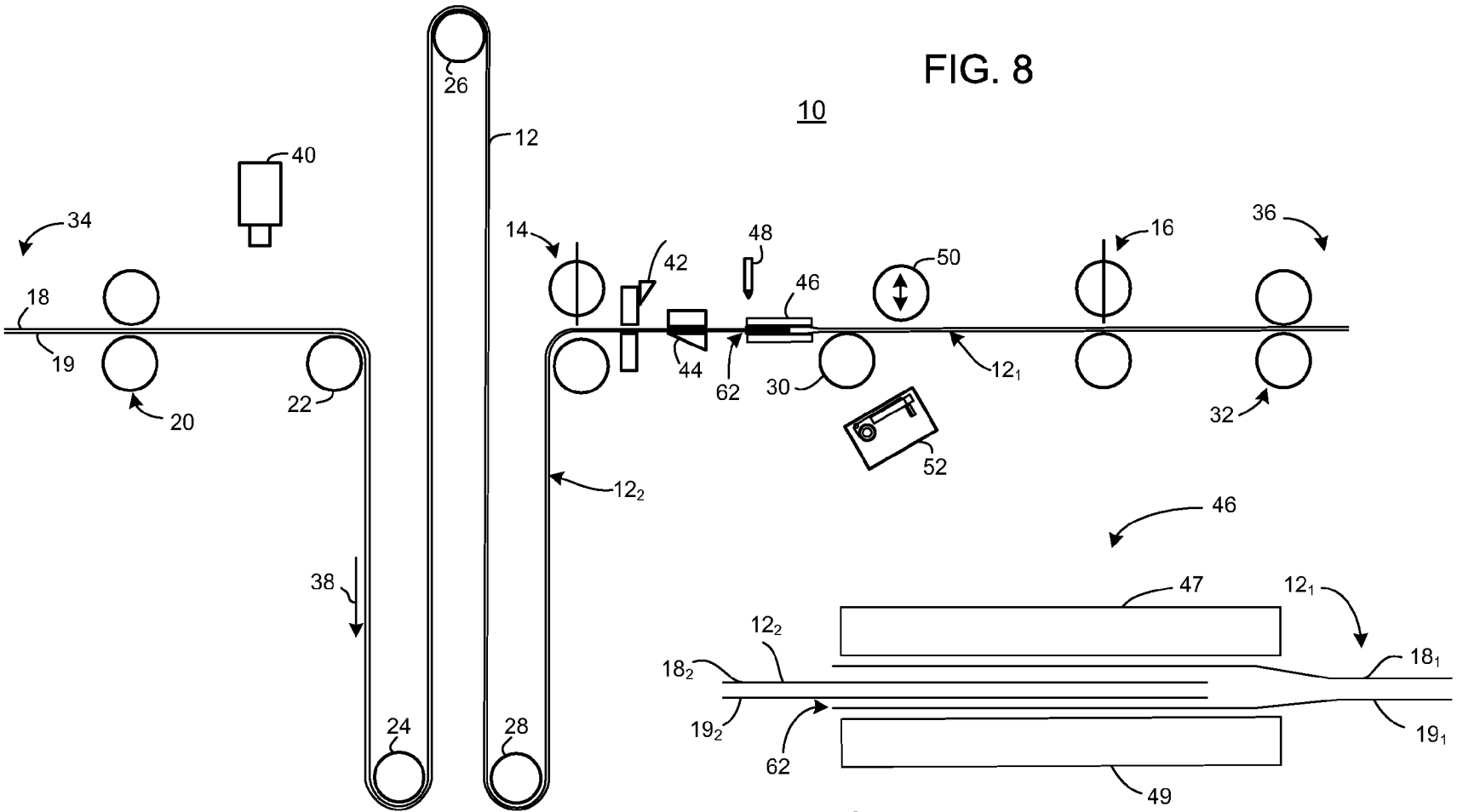
FIG. 8 is a schematic illustration of an embodiment of the apparatus effecting an establishing of a multi-layer structure to carry out a splicing operation.
FIG. 9 is an enlarged schematic illustration showing details of a multi-layer structure.

FIG. 8 is a schematic illustration of an embodiment of the apparatus effecting an establishing of a multi-layer structure to carry out a splicing operation. In FIG. 8, layer manipulating unit 46 may be closed to generally capture a portion of trailing segment $\mathbf{12}_2$ of workpiece 12 between layers 18, 19 of leading portion $\mathbf{12}_1$ of workpiece 12 to establish a multi-layer structure in a spliced portion 62 in now-spliced workpiece 12.

FIG. 9 is an enlarged schematic illustration showing details of a multi-layer structure. In FIG. 9, jaw members 47, 49 of layer manipulating unit 46 may be closed to establish a multi-layer structure in a spliced portion 62. The multi-layer structure may include layers $\mathbf{18}_2$, $\mathbf{19}_2$, of trailing segment $\mathbf{12}_2$ of workpiece 12 in captive relation between layers $\mathbf{18}_1$, $\mathbf{19}_1$ of leading segment $\mathbf{12}_1$ of workpiece 12.

Figure 10:
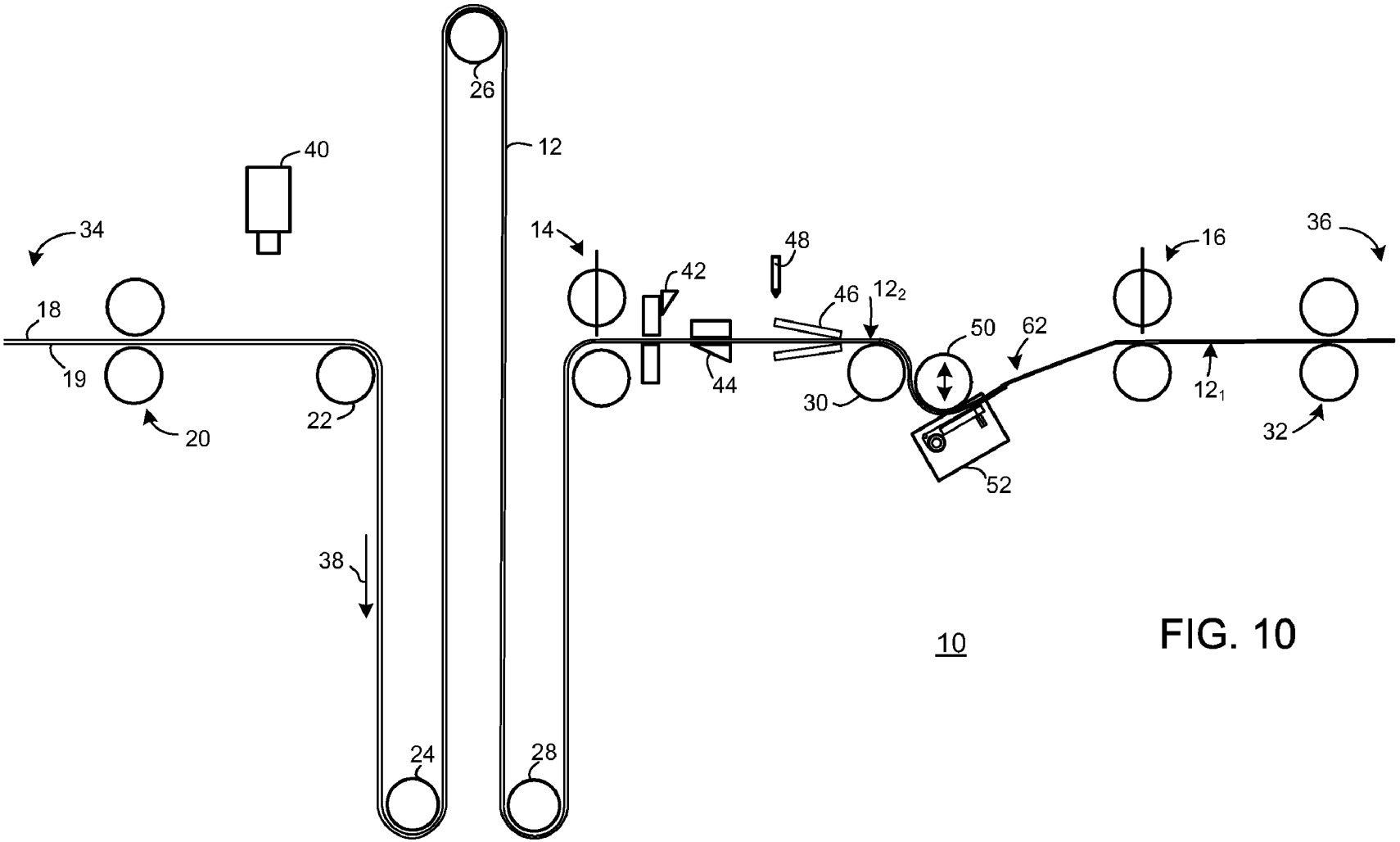
FIG. 10 is a schematic illustration of an embodiment of the apparatus effecting an orientation of a workpiece to accommodate application of adhesive to a multi-layer structure to carry out a splicing operation.

FIG. 10 is a schematic illustration of an embodiment of the apparatus effecting an orientation of a workpiece to accommodate application of adhesive to a multi-layer structure to carry out a splicing operation. In FIG. 10, layer manipulating unit 46 may have been opened to permit workpiece 12 to pass through or past layer manipulating unit 46. Workpiece deflecting unit 50 may cooperate with adhering unit 52 to situate workpiece 12 in an applying position for adhering unit 12 applying adhesive to workpiece 12 in an area generally situated about splice portion 62. At least one of drive units 14, 16 may have advanced workpiece 12 to situate splice portion 62 generally in the applying position for adhering unit 52.

Figures 11, 12:
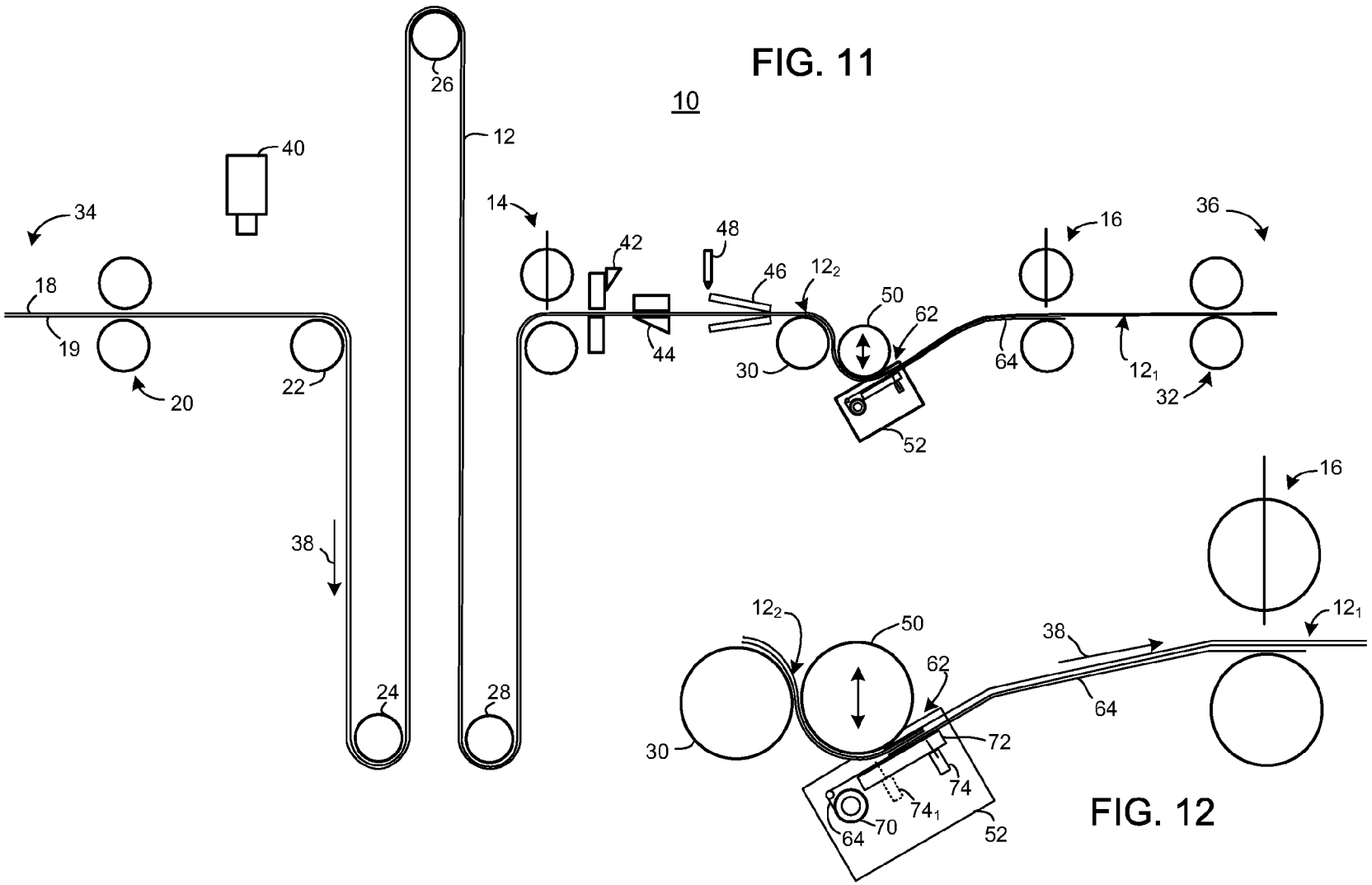
FIG. 11 is a schematic illustration of an embodiment of the apparatus effecting an application of adhesive to a multi-layer structure in a workpiece to carry out a splicing operation.
FIG. 12 is an enlarged schematic illustration showing details of application of adhesive to a multi-layer structure.

FIG. 11 is a schematic illustration of an embodiment of the apparatus effecting an application of adhesive to a multi-layer structure in a workpiece to carry out a splicing operation. In FIG. 11, adhering unit 52 applies an adhesive in the vicinity of splice portion 62. Adhesive applied by adhering unit 52 may be brushed on, spot-dabbed on or otherwise applied. In FIG. 11, adhesive may be applied using a length of adhesive tape 64 having sufficient length to overlay splice portion 62 and being substantially in register with workpiece 12. Application of adhesive tape 64 may be effected as workpiece 12 is driven past adhering unit 52 by one of both of drive units 14, 16.

FIG. 12 is an enlarged schematic illustration showing details of application of adhesive to a multi-layer structure. In FIG. 12, guide structure 30 and workpiece deflecting unit 50 may cooperate with adhering unit 52 to situate workpiece 12 generally adjacent to adhering unit 52. Adhering unit 52 may include adhesive tape 64 stored on a supply reel 70 or similar supply mechanism, an anvil 72 or similar bearing surface and a cutting structure 74 or knife. Workpiece 12 may be routed between workpiece deflecting unit 50 and adhesive tape 64. Adhesive tape 64 may be oriented between workpiece 12 and anvil 72. With such an orientation among workpiece deflecting unit 50, workpiece 12, adhesive tape 64 and anvil 72 pressure may be exerted by workpiece deflecting unit 50 against anvil 72 to urge adhesive tape 64 against workpiece 12. Such an arrangement may effect application of adhesive tape 64 to workpiece 12 in the vicinity of splice portion 62 as at least one of drive units 14, 16 drives workpiece 12 along working path 38. Once adhesive tape 64 is applied along a sufficient length of workpiece 12 spanning splice portion 62, cutting structure 74 may be reoriented to a cutting position (indicated in phantom as a cutting unit $\mathbf{74}_1$ in FIG. 12) for severing adhesive tape 64 without severing workpiece 12. Alternately, cutting structure 74 may be fixed within adhering unit 52, and adhering unit 52 may be reoriented in its entirety (e.g., to the left in FIG. 12; not shown in FIG. 12) to situate cutting structure 74 for severing adhesive tape 64 without severing workpiece 12. If adhesive is embodied in a form other than adhesive tape 64, application of adhesive to splice portion 62 may be effected in an expanse of workpiece 12 short of spanning splice portion 62.

Figure 13:
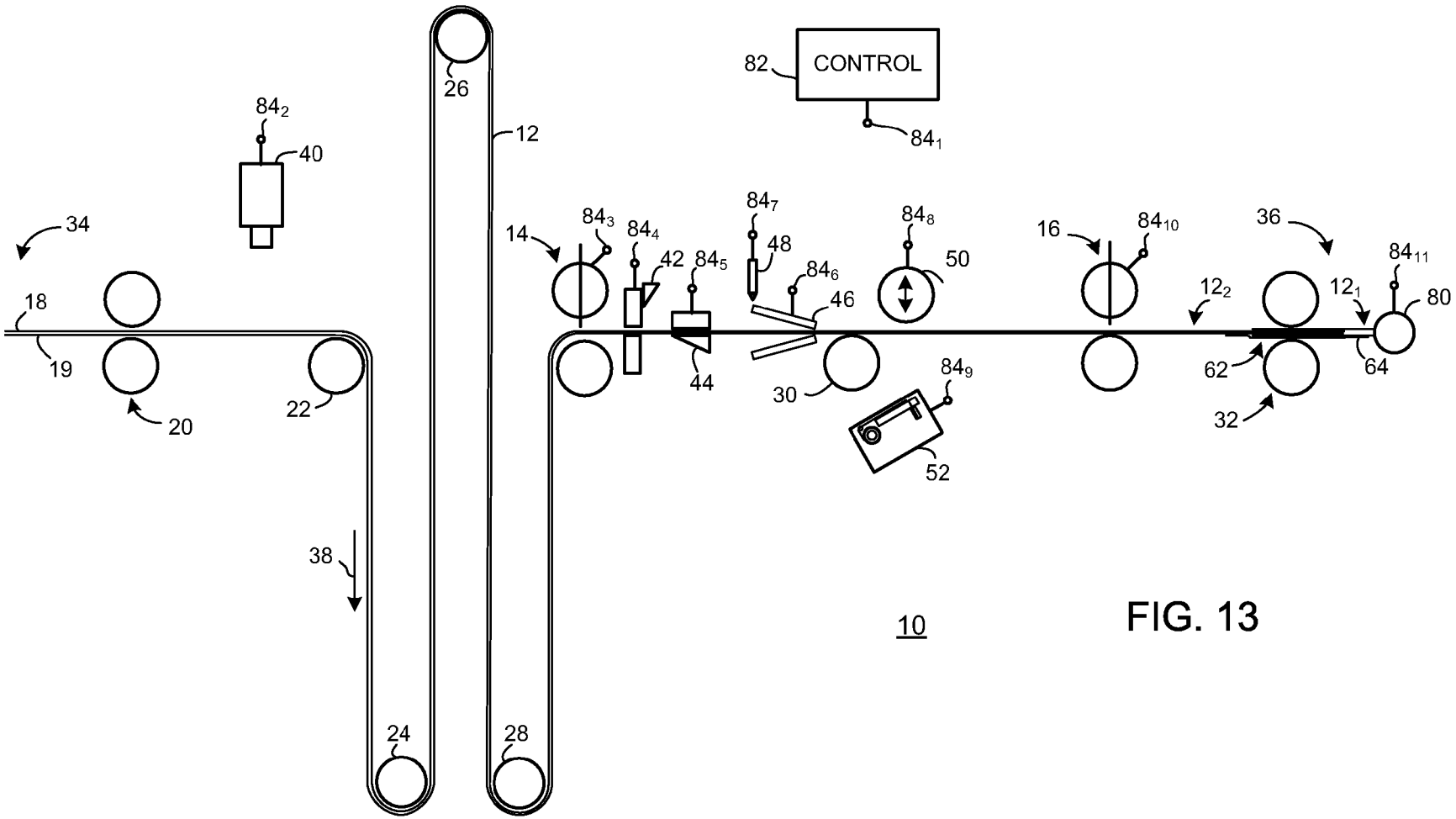
FIG. 13 is a schematic illustration of an embodiment of the apparatus effecting a testing of a splice in a workpiece.

FIG. 13 is a schematic illustration of an embodiment of the apparatus effecting a testing of a splice in a workpiece. In FIG. 13, after adhesive tape 64 (or another adhesive material) is applied to splice portion 62 of workpiece 12 may be subjected to tension to test splice portion 62. By way of example and not by way of limitation, a tension force may be applied to workpiece 12 by grippingly engaging trailing segment $\mathbf{12}_2$ of workpiece 12 using one or both of drive units 14, 16 and operating a take-up reel 80 to collect leading segment $\mathbf{12}_1$ of workpiece 12. A tension force may thereby be applied between, for example, drive unit 16 and take-up reel 80 to effect tension-testing of splice portion 62.

Splicing apparatus 10 may include a control unit 82 for generally coordinating operation of various components of apparatus 10 in proper sequence to effect the steps described above on connection with FIGS. 1-13. Control unit 82 may be coupled with various components of apparatus 10 in wired connection, in wireless connection or in combination of wired and wireless connection. Connection loci $\mathbf{84}_n$ included in FIG. 13 may indicate connection among various components of apparatus 10 and control unit 82. The indicator "n" is employed to signify that there can be any number of connection loci in splicing apparatus 10. The inclusion of eleven connection loci $\mathbf{84}_1$-$\mathbf{84}_{11}$ (described below) in FIG. 13 is illustrative only and does not constitute any limitation regarding the number of connection loci that may be included in an embodiment of the splicing apparatus of the present invention. A connection locus $\mathbf{84}_1$ may indicate a wireless or wired connection with control unit 82. A connection locus $\mathbf{84}_2$ may indicate a wireless or wired connection between defect detector unit 40 and control unit 82. A connection locus $\mathbf{84}_3$ may indicate a wireless or wired connection between drive unit 14 and control unit 82. A connection locus $\mathbf{84}_4$ may indicate a wireless or wired connection between cutting unit 42 and control unit 82. A connection locus $\mathbf{84}_5$ may indicate a wireless or wired connection between workpiece redirecting unit 44 and control unit 82. A connection locus $\mathbf{84}_6$ may indicate a wireless or wired connection between layer manipulating unit 46 and control unit 82. A connection locus $\mathbf{84}_7$ may indicate a wireless or wired connection between heater element 48 and control unit 82. A connection locus $\mathbf{84}_8$ may indicate a wireless or wired connection between workpiece deflecting unit 50 and control unit 82. A connection locus $\mathbf{84}_9$ may indicate a wireless or wired connection between adhering unit 52 and control unit 82. A connection locus $\mathbf{84}_{10}$ may indicate a wireless or wired connection between drive unit 16 and control unit 82. A connection locus $\mathbf{84}_{11}$ may indicate a wireless or wired connection between take-up reel 80 and control unit 82.

Figure 14:
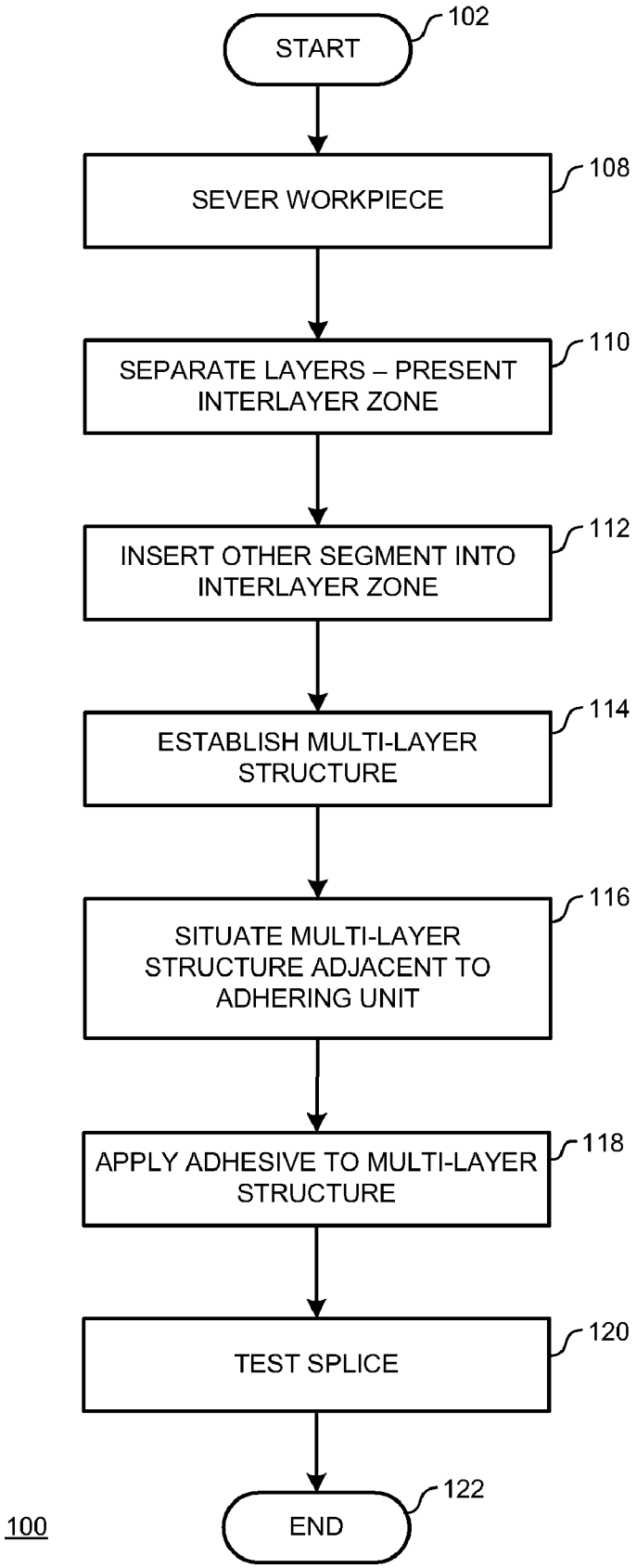
FIG. 14 is a flow chart illustrating an embodiment of the method of the invention.

FIG. 14 is a flow chart illustrating an embodiment of the method of the invention. In FIG. 14, a method 100 for splicing an elongate workpiece begins at a START locus 102. The workpiece may include a plurality of materials substantially abuttingly oriented in a plurality of layers.

Method 100 may continue by severing the workpiece to present a first segment of the workpiece and a second segment of the workpiece, as indicated by a block 108. Prior to severing the workpiece, a flaw or splice may be detected that may be removed from the workpiece before continuing with method 100. Method 100 may continue by separating a portion of one segment of the first segment and the second segment to present an interlayer zone in the one segment, as indicated by a block 110.

Method 100 may continue by inserting an other segment of said first segment and said second segment than said one segment in the interlayer zone, as indicated by a block 112. Method 100 may continue by urging the selected layers together to generally capture the other segment within the interlayer zone to effect said splicing in a multi-layer structure, as indicated by a block 114. Method 100 may continue by situating the multi-layer structure adjacent to the adhering unit, as indicated by a block 116. Method 100 may continue by strengthening the splicing by applying the adhesive to the multi-layer structure, as indicated by a block 118.

Method 100 may continue by testing the splice established in the workpiece such as, by way of example and not by way of limitation, applying a tensioning force to the multi-layer structure, as indicated by a block 120. Method 100 may terminate at an end locus 122.

Figure 15:
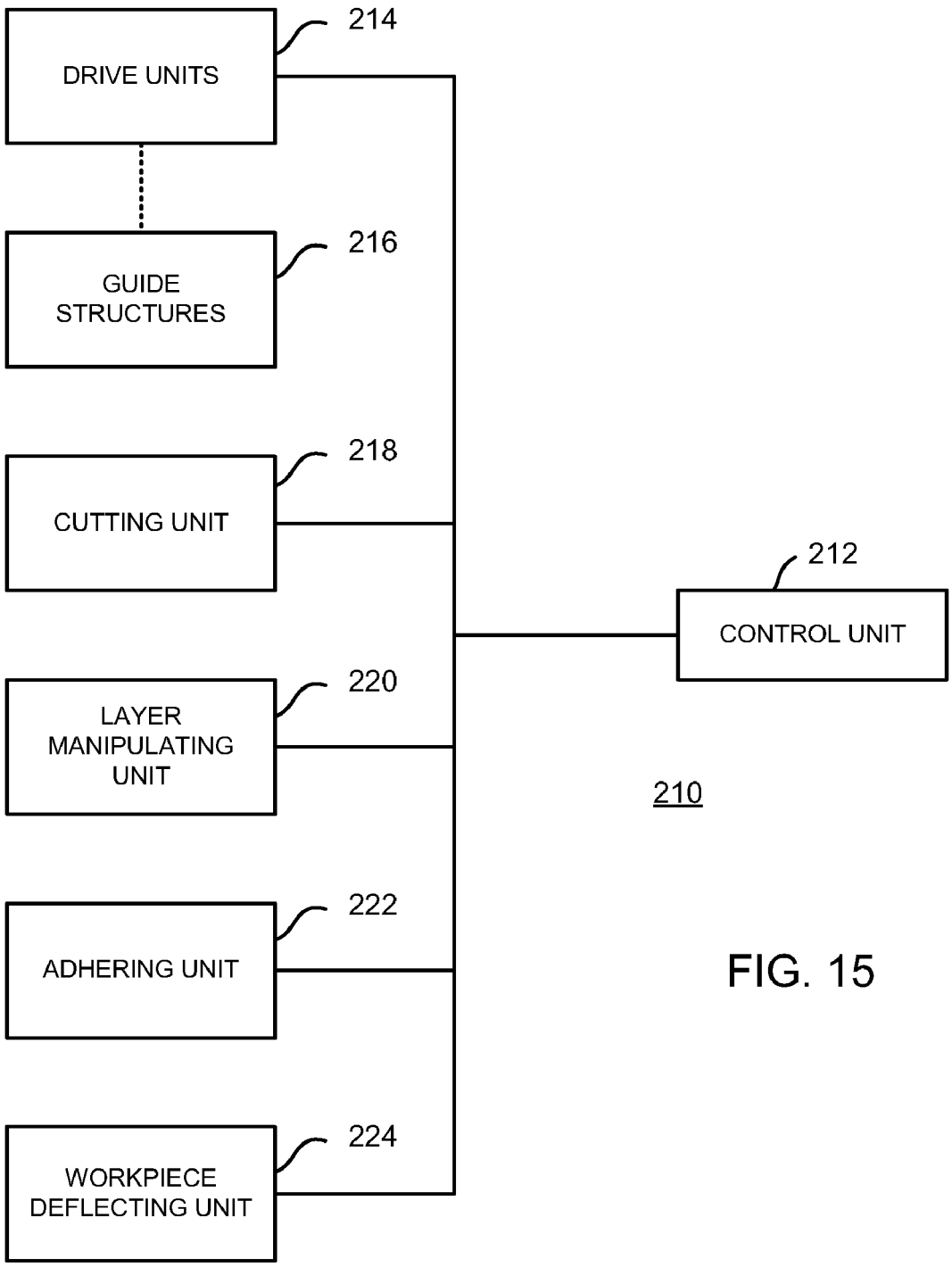
FIG. 15 is a functional chart illustrating an embodiment of the apparatus of the invention.

FIG. 15 is a functional chart illustrating an embodiment of the apparatus of the invention. In FIG. 15, an apparatus 210 configured for splicing of an elongate workpiece including a plurality of materials substantially abuttingly oriented in a plurality of layers may include a control unit, indicated by a block 214. A plurality of drive units, indicated by a block 216, may be coupled with control unit 214 and arranged for driving the workpiece along a working path. The workpiece and workpath are not shown in FIG. 15; see FIGS. 1-13.

A plurality of guide structures, indicated by a block 216, may be arranged for cooperating with the plurality of drive units 214 for guiding the workpiece along the working path. The arrangement for cooperating is indicated by a dotted line in FIG. 15; guide structures 216 may or may not be coupled with drive units 214.

A cutting unit, indicated by a block 218, may be coupled with control unit 212 for selectively severing the workpiece. A layer manipulating unit, indicated by a block 220, may be coupled with control unit 212 for moving selected layers of the plurality of layers. An adhering unit, indicated by a block 222, may be coupled with control unit 212 for applying an adhesive to at least one portion of the workpiece. A workpiece deflecting unit, indicated by a block 224, may be coupled with control unit 212 for selectively deflecting the workpiece from the working path.

Cutting unit 218 may cooperate with control unit 212 for effecting the severing to present a first segment of the workpiece and a second segment of the workpiece. Layer manipulating unit 220 may cooperate with control unit 212 after the severing for effecting an inter-layer separation in a portion of one segment of the first segment and the second segment to present an interlayer zone in the one segment.

At least one drive means of the plurality of drive means 214 may cooperate with control unit 212 after the separation for inserting the other segment in the interlayer zone. Layer manipulating unit 220 may cooperate with control unit 212 after the inserting for urging the selected layers together to generally capture the other segment within the interlayer zone to establish a multi-layer structure. Plurality of drive units 214 and at least one of workpiece deflecting unit 224 and adhering unit 222 may cooperate with control unit 212 after the urging to situate the multi-layer structure adjacent to adhering unit 222. Adhering unit 222 may cooperate with control unit 212 after the situating for finishing the splicing by applying adhesive to the multi-layer structure.

It is to be understood that, while the detailed drawings and specific examples given describe embodiments of the invention, they are for the purpose of illustration only, that the apparatus and method of the invention are not limited to the precise details and conditions disclosed and that various changes may be made therein without departing from the spirit of the invention which is defined by the following claims:

We claim:

1. A method for splicing an elongate workpiece; said workpiece including a plurality of materials substantially abuttingly oriented in a plurality of layers; the method comprising:

(a) severing of said workpiece to present a first segment of said workpiece and a second segment of said workpiece;

(b) separating at least two selected layers of said plurality of layers in a portion of one segment of said first segment and said second segment to present an interlayer zone in said one segment; said interlayer zone being bounded only on two generally facing sides by two respective layers of said at least two selected layers;

(c) inserting an other segment of said first segment and said second segment than said one segment in said interlayer zone;

(d) urging said at least two selected layers together to generally capture said other segment within said interlayer zone to establish interlayer adhesion among said other segment and said at least two selected layers in a multi-layer structure to effect said splicing;

(e) situating said multi-layer structure adjacent to an adhering unit; and (f) operating said adhering unit to effect strengthening said splicing by applying an adhesive to said multi-layer structure.

2. A method for splicing an elongate workpiece as recited in claim 1 wherein said plurality of materials comprises a working material in a first layer and a backing material in a second layer; said working material and said backing material being in an adhesively abutting relation.

3. A method for splicing an elongate workpiece as recited in claim 2 wherein said interlayer manipulating unit applies a vacuum to each of said first layer and said second layer to effect said inter-layer separation.

4. A method for splicing an elongate workpiece as recited in claim 1 wherein the method further comprises a step (b)(1) following step (b) and preceding step (c):

(b)(1) operating a heater element for effecting heating of said workpiece.

5. A method for splicing an elongate workpiece as recited in claim 1 wherein the method further comprises a step (g) following step (f):

(g) operating a tensioning unit to apply a tension force to said multi-layer structure after said adhesive is applied.

6. A method for splicing an elongate workpiece as recited in claim 2 wherein the method further comprises a step (g) following step (f):

(g) operating a tensioning unit to apply a tension force to said multi-layer structure after said adhesive is applied.

* * * * *

UNITED STATES PATENT AND TRADEMARK OFFICE

CERTIFICATE OF CORRECTION

PATENT NO. : 7,803,242 B2
APPLICATION NO. : 11/763013
DATED : September 28, 2010
INVENTOR(S) : Thomas J. Hagman et al.

It is certified that error appears in the above-identified patent and that said Letters Patent is hereby corrected as shown below:

On the Title Page,
1. Item (75) Inventor "Ross Hutter" should read --Ross Hunter--
2. Item (73) Assignee "Boeing Company" should read --The Boeing Company--

Signed and Sealed this

Ninth Day of November, 2010

David J. Kappos

David J. Kappos
*Director of the United States Patent and Trademark Office*